US005533917A

United States Patent [19]

Schmitz

[11] Patent Number: 5,533,917

[45] Date of Patent: Jul. 9, 1996

[54] CABLE COORDINATING APPARATUS AND METHOD

[76] Inventor: David P. Schmitz, 19045 Lothmoor Dr. Upper, Brookfield, Wis. 54301

[21] Appl. No.: 277,178

[22] Filed: Jul. 19, 1994

[51] Int. Cl.[6] ..... H01R 9/22

[52] U.S. Cl. ..... 439/894; 439/488; 439/491; 40/316; 174/112

[58] Field of Search ..... 439/894, 491, 439/488; 174/112; 40/316

[56] References Cited

U.S. PATENT DOCUMENTS

| | | | |
|---|---|---|---|
| 2,605,566 | 8/1952 | De Dell | 40/316 |
| 3,331,915 | 7/1967 | Lucci | 174/66 |
| 3,989,338 | 11/1976 | Gosser | 439/491 |
| 4,090,766 | 5/1978 | Buhr et al. | 339/113 |
| 4,998,343 | 5/1991 | Costello | 29/857 |
| 5,130,890 | 7/1992 | Nhu | 361/390 |

*Primary Examiner*—David L. Pirlot
*Assistant Examiner*—T. C. Patel
*Attorney, Agent, or Firm*—Andrus, Sceales, Starke & Sawall

[57] ABSTRACT

A card for indicating the relative positions of conductors to be connected to an appliance comprises a panel element independent of the appliance and representing a duplicate image of a portion of the appliance to which the conductors are to be connected. The panel element includes a plurality of openings provided therein, each of the openings being formed to frictionally retain one of the conductors at a location on the panel element corresponding to the exact location of the conductor when connected to the appliance.

10 Claims, 2 Drawing Sheets

CABLE COORDINATING APPARATUS AND METHOD

TECHNICAL BACKGROUND

The invention relates generally to the handling of conductors adapted to be connected to and disconnected from the receptacles of electrical and other appliances having multiple line connections.

BACKGROUND OF THE INVENTION

Electrical appliances such as computers, video cassette recorders (VCRs), stereo tuners, tape decks and CD players, are powered and interconnected via a plurality of cables, cords and wires plugged into receptacles on a portion of the electrical appliance. Periodically, such cables, cords and wires must be unplugged from their receptacles to facilitate servicing or transportation of the electrical appliance. In the course of disconnection, the cables, cords and wires often form a small jungle of disorganized conductors subject to being stepped on and damaged. In addition, the withdrawn conductors assume a jumbled orientation which makes reconnection subsequent to repair or transport frustrating, time-consuming, and, in some cases, potentially dangerous.

One example of a device for preventing damage and mix-up of cables as a result of operations involving withdrawal of a cable connector from multi-terminal types of computer equipment is shown in U.S. Pat. No. 5,130,890 issued Jul. 14, 1992 to Nhu. In this device, a support panel is hingedly connected to the cabinet frame of computer equipment for pivotal displacement about an axis parallel to a common plane with which the access terminals of the computer equipment are aligned. The panel is thereby displaced to an operative position in an angular relation to the terminal alignment plane exposing a plurality of retainer devices for reception and withdrawal of cable connectors. The cable connectors may thereby be held on the support panel in spaced relation to each other in a convenient arrangement with cables extending therefrom adjacent to the access terminals. The retainer devices according to one embodiment are in the form of angularly adjustable clamps carried on the panel to accommodate reception of standard, low level serial or parallel connectors/adapters. According to other embodiments, the retainer devices are edge recesses or holes formed in the support panel to receive and hold connectors on the panel while in its operative position extending perpendicular to the terminal alignment plane.

While the use of this device contemplates retention of disconnected cables in an orderly arrangement, it is necessary that the cables be tagged for identification purposes, which procedure is time-consuming and wasteful. In addition, since the Nhu device is fashioned particularly for reprogramming and testing, it requires a support panel to be hingedly connected on the appliance cabinet. This feature is particularly restrictive in instances where the cables must be disconnected from an appliance which is to be serviced or transported. Accordingly, it remains desirable to provide a cable coordinating apparatus and method of a modified type from that shown in the prior art which is effective to safely and conveniently retain conductors disconnected from an appliance in an array duplicative of the manner in which the conductors are to be connected to the appliance. It is also highly desirable that such apparatus have a minimum number of components and be economical.

SUMMARY OF THE INVENTION

The cable coordinating apparatus and method of the present invention advantageously provides positive, reliable securement for disconnected cables, cords, wires and the like. The apparatus has a simple, unique construction designed to enable fast installation and removal of appliance conductors.

These and other aspects of the invention are realized in a card for indicating the relative positions of the conductors to be connected to an appliance. The card comprises a panel element independent of the appliance and represents a duplicate image of a portion of the appliance to which the conductors are to be connected. The panel element includes a plurality of openings provided therein, each of the openings being formed to friction-ally retain one of the conductors at a location on the panel element corresponding to the location of the conductor when connected to the appliance.

In another aspect of the invention recited in combination with a cabinet enclosing an appliance having a plurality of receptacles adapted to receive various conductors, means are provided for holding the conductors in relative positions corresponding to their positions on the cabinet while the conductors are disconnected from the appliance during servicing or transportation. The means comprises a support means which is independent of the cabinet and includes a retainer means provided in the support means for releasably supporting the conductor in an arrangement identical to the receptacles on the cabinet. The retainer means comprises at least one aperture formed in the support means being at least dimensionally equal to the conductor to be retained therein and at least one slit communicating the support means with the at least one aperture.

In yet another aspect of the invention, a card is contemplated for indicating the relative positions of cables, wires and the like to be connected to an appliance. The card comprises a panel element representing an image of a portion of the appliance to which the cables, wires and the like are to be connected. The panel element includes a plurality of apertures having surrounding walls and a corresponding plurality of slits formed therein, each of the slits communicating the periphery of the panel element with one of the apertures and each of the apertures being at least dimensionally equal to each of the cables, wires and the like whereby each of the cables, wires and the like to be connected to the appliance are slidable along one of the slits and temporarily retained within the walls of one of the apertures indicating the relative position of the cable, wires or the like on the appliance.

In yet another aspect of the invention, a method is utilized for disconnecting, retaining and connecting a plurality of conductors relative to receptacles on an appliance to be serviced or transported. The method comprises the steps of: providing a panel element representing an image of a portion of the appliance to which the conductors are to be connected; forming a plurality of apertures having surrounding walls in said panel element at locations corresponding to the locations of the receptacles on the appliance and with sizes corresponding to the sizes of the conductors; cutting slits in the panel element, each of the slits communicating the panel element with a respective one of the apertures; providing one of the conductors from its receptacles on the appliance; guiding the conductor along one of the slits into a respective one of the apertures at a location corresponding to the receptacle from which the conductor was disconnected; frictionally retaining the periphery of the conductor within the surrounding walls of the aperture formed in the panel element while the appliance is being serviced or transported; repeating the aforementioned steps for additional conductors for the first step until all conductors are retained within the panel element; and upon disconnecting each of the conductors from its receptacle on the appliance, connecting each of the conductors to the receptacle corresponding to the location on the panel element.

BRIEF DESCRIPTION OF THE DRAWINGS

The invention will become better understood by reference to the following detailed description of the preferred exemplary embodiment when read in conjunction with the appended drawing, wherein like numerals denote like elements.

DETAILED DESCRIPTION OF THE PREFERRED EMBODIMENT

Figure 1:
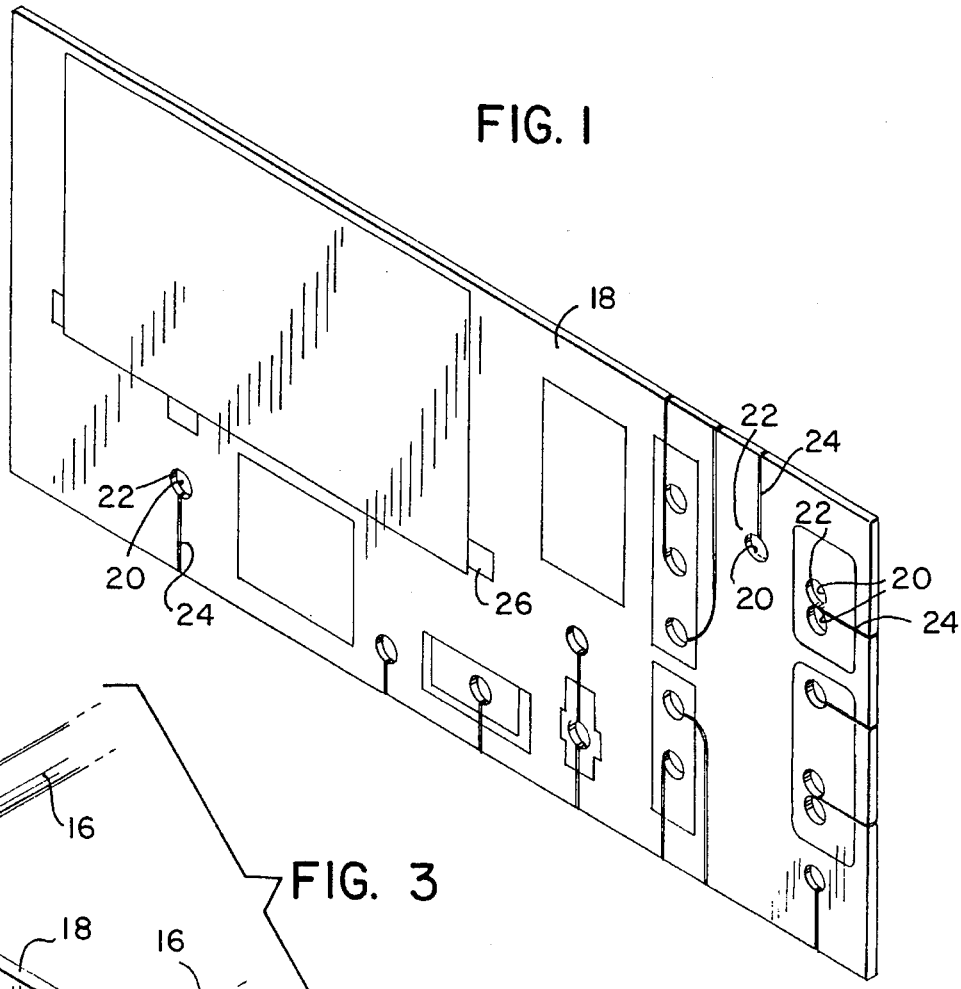
FIG. 1 is a perspective view of a cable coordinating apparatus embodying the present invention.
Figure 2:
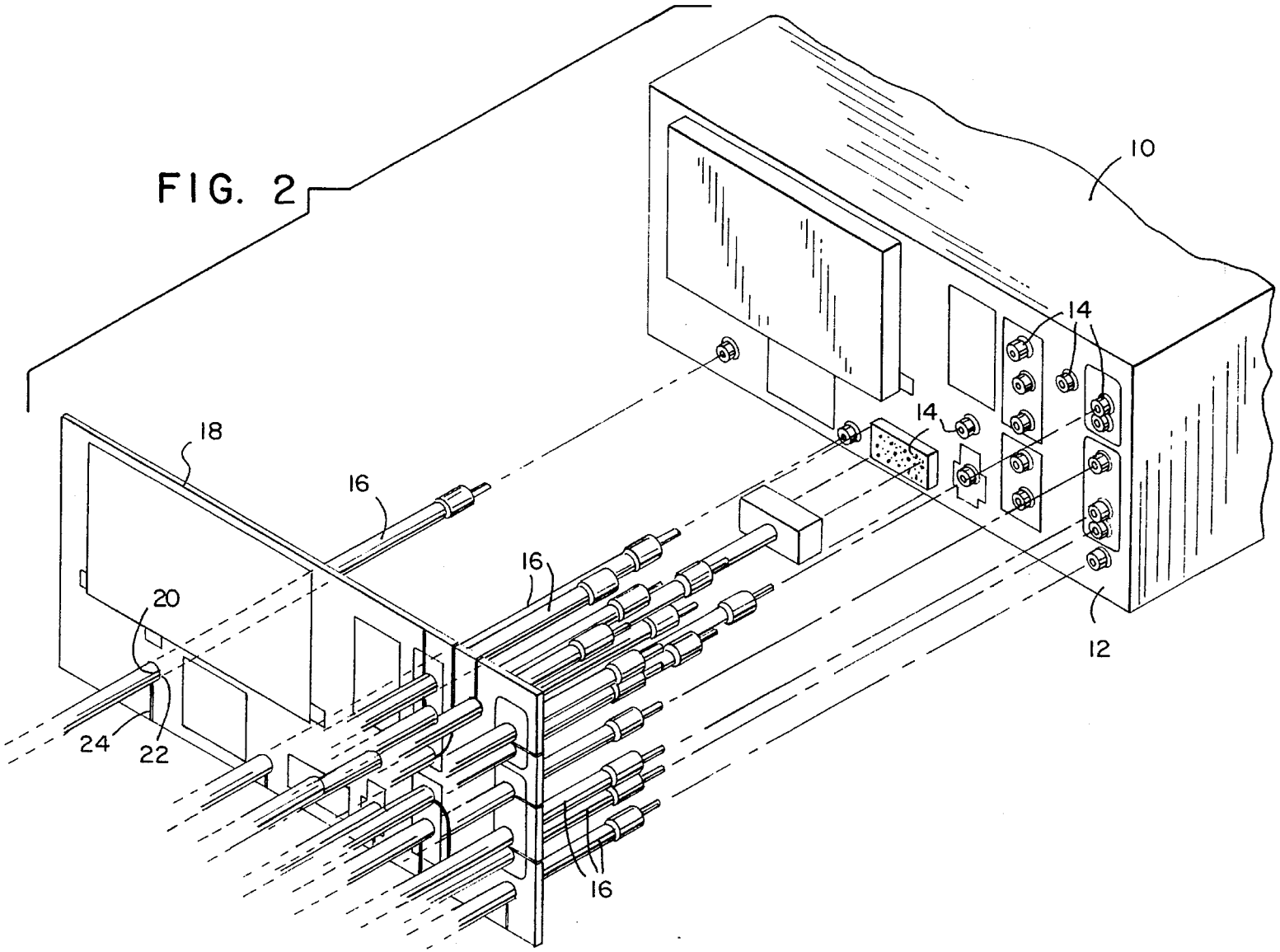
FIG. 2 is a perspective view of the cable coordinating apparatus in use with all cables of a videotape editing deck disconnected.

Referring now to the drawings, particularly FIGS. 1 and 2, an electrical appliance in the form of a videotape editing deck 10 has a rear cabinet portion 12 having a plurality of receptacles 14 into which various sized cables, wires and like conductors 16 are plugged. While the electrical appliance chosen for illustration is depicted as an editing deck, it should be appreciated that the electrical appliance may just as easily assume the configuration of a computer component, video cassette recorder, tape deck, CD player or other audio/video component. As is well known, conductors 16 connect these components with telephones, power sources, printers and other peripheral equipment (not shown).

Figure 3:
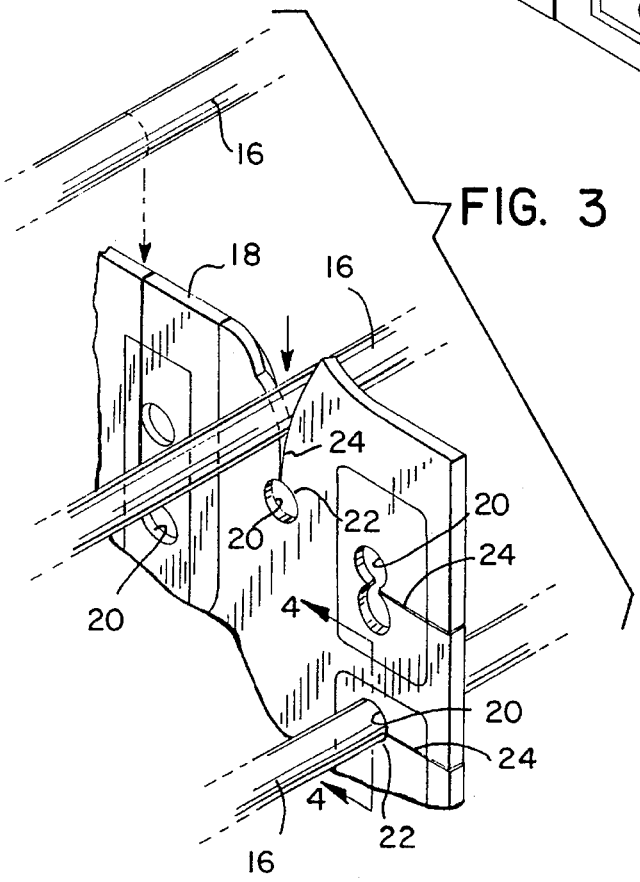
FIG. 3 is a fragmentary, perspective view of the cable coordinating apparatus indicating the manner in which a single cable is retained in the cable coordinating apparatus.
Figure 4:
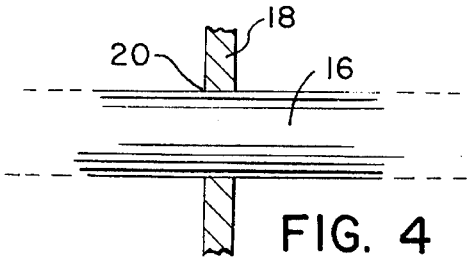
FIG. 4 is a cross-sectional view taken on line 4—4 of FIG. 3.

As a salient feature of the invention, a cable coordinating apparatus embodying the present invention comprises a flexible card or panel element 18 completely separate and independent of yet stationed directly adjacent to the editing deck 10 and representing a duplicate image of and having the same physical size as the portion of the electrical appliance to which conductors 16 are to be connected. Panel element 18 includes a plurality of variously sized openings 20 provided therein for releasably supporting conductors 16 in an arrangement identical to the receptacles 14 on editing deck 10. Each opening 20 is formed to frictionally retain one of the conductors 16 at a location corresponding to the exact location of the conductor 16 when connected to the editing deck 10. As shown in FIGS. 2 and 3, each opening 20 is at least dimensionally equal to the size of conductor 16, the entire periphery of which is to be retained therein by the surrounding walls 22 of panel element 18. Each opening 20 is provided with a slit 24 cut into panel element 18 which communicates the periphery of panel element 18 with the interior of opening 20 such that a conductor 16 disconnected or unplugged from editing deck 10, is manually slidable along slit 24 into frictional engagement with walls 22 of opening 20 at a location corresponding to the exact location of the conductor 16 when connected to the editing deck 10.

It should be apparent that with the arrangement described above, conductors 16 plugged into receptacles 14 on editing deck 10 may be disconnected from receptacles 14 and retained on independent panel element 18 in a manner which will not only safeguard conductors 16 but will allow absolutely optimum reconnection of conductors 16 without tagging identification.

Figure 5:
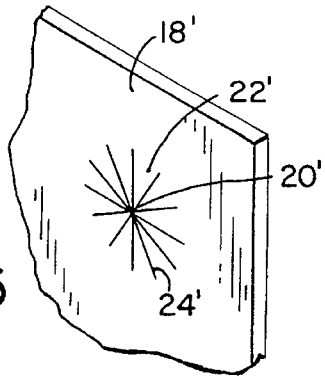
FIG. 5 is a fragmentary, perspective view of an alternative embodiment of the cable coordinating apparatus.

In the embodiment of FIG. 5, panel element 18' is provided with expandable openings 20' each of which is formed with at least one slit and preferably a series of slits 24' extending radially outwardly to walls 22' surrounding opening 20'. This arrangement, similar to that which holds Christmas tree bulbs in packaging, again allows a disconnected conductor 16 to be manipulated via slits 24' into frictional engagement with walls 22' of opening 20' at locations corresponding to the exact location of conductors 16 when connected to editing deck 10.

In use, when conductors 16 are about to be connected to receptacles 14 of the particular appliance to be serviced or transported at some future point in time, an independent card or panel element 18, 18' with appropriate openings 20, 20' and slits 24, 24' is provided to be stationed directly adjacent the appliance. The panel element 18, 18' which represents a duplicative image of a portion of the electrical appliance to which conductors 16 are to be reconnected is prepared either by the appliance manufacturer, a post purchase supplier, or the user. Then, as shown in FIG. 3, one by one, each conductor 16 is guided forcibly by hand along one of the slits 24, 24' into a respective opening 20, 20' at a location corresponding to the exact receptacle 14 from which the conductor 16 was disconnected. Once each conductor 16 enters the opening 20, 20', it is frictionally held in place by the surrounding walls 22, 22' of the opening 20,20'. When the electrical device is ready to be serviced or transported, conductors 16 are simply withdrawn from panel element 18, 18' and easily and surely reconnected to the receptacles 14 after servicing or transportation at exact locations corresponding to their locations on panel element 18, 18'.

While the invention has been described with reference to a preferred embodiment, those skilled in the art will appreciate that certain substitutions, alterations and omissions may be made without departing from the spirit thereof. For example, while the invention has been described with reference to an electrical appliance, it should be understood that the invention is equally applicable to other technologies requiring multiple line connections such as powder, liquid, gas mixing and exhaust devices. In other words, the invention is useful with other mechanical appliances requiring interchangeability of lines and a necessary pattern of connection determined by multiple lines in the base appliance. Furthermore, since the panel element 18, 18' is stationed directly adjacent the base appliance, a conventional or off-the-shelf, audio-visual sensing or alarm device 26 could be incorporated into the panel element 18, 18' to detect and/or address any problems related to heat or fire. Accordingly, the foregoing description is meant to be exemplary only, and should not be deemed limitative on the scope of the invention set forth in the accompanying claims.

I claim:

1. A card for indicating the relative positions of conductors to be connected to an appliance, said card comprising:

a panel element independent of the appliance and representing a duplicate image of a portion of the appliance to which the conductors are to be connected, said panel element including a plurality of openings provided therein, each of said openings being formed to frictionally retain one of the conductors at a location on said panel element corresponding to the exact location of the conductor when connected to the appliance wherein said panel element includes an alarm means for sensing heat and fire.

2. The card according to claim 1, wherein each of said openings is surrounded by walls engageable with the entire periphery of said conductors.

3. In combination with a cabinet enclosing an appliance having a plurality of receptacles adapted to receive various conductors, means for holding the conductors in relative positions corresponding to their positions on the cabinet while the conductors are disconnected from the appliance during servicing or transportation, said means comprising:

a support means independent of the cabinet; and retainer means provided in said support means for releasably supporting the conductors in an arrangement identical to the receptacles on the cabinet, said retainer means comprising at least one aperture formed in said support means being at least dimensionally equal to the conductor to be retained therein and at least one slit communicating said support means with said one aperture to permit a respective conductor to be inserted into the aperture via said slit.

4. The card according to claim 3, wherein the appliance is a computer.

5. The card according to claim 3, wherein the appliance is an audio component.

6. The card according to claim 3, wherein the appliance is a video component.

7. The combination of claim 3, wherein said support means comprises a flexible card having the same physical size as the portion of the cabinet to which the conductors are connected.

8. The combination of claim 3, wherein said aperture has surrounding walls frictionally engageable with the entire periphery of said conductor retained in said aperture.

9. A card for indicating the relative positions of cables and wires to be connected to an appliance, said card comprising:

a panel element representing an image of a portion of the appliance to which the cables and wires are to be connected, said panel element including a plurality of apertures having surrounding walls and a corresponding plurality of slits formed therein, each of said slits communicating the periphery of said panel element with one of said apertures and each of said apertures being at least dimensionally equal to each of the cables and wires whereby each of the cable and wires to be connected to the appliance are manually slidable along one of said slits and temporarily retained within the walls of one of said apertures indicating the relative position of the cable and wires on the appliance.

10. A method for disconnecting, retaining and connecting a plurality of conductors relative to receptacles on an appliance to be serviced or transported, the method comprising the steps of:

a) providing a panel element representing an image of a portion of the appliance to which the conductors are to be connected;

b) forming a plurality of apertures having surrounding walls in said panel element at locations corresponding to the locations of the receptacles on the appliance and with sizes corresponding to the sizes of the conductors;

c) cutting slits in said panel element, each of said slits communicating said panel element with a respective one of said apertures;

d) providing one of the conductors from its receptacle on the appliance;

e) guiding the conductor along one of said slits into a respective one of said apertures at a location corresponding to the receptacle from which the conductor was disconnected;

f) frictionally retaining the periphery of said conductor within said surrounding walls of said apertures formed in said panel element;

g) repeating steps a) through f) for additional conductors of the first step until all conductors are retained within said panel element; and h) upon disconnecting each of the conductors from its receptacle on the appliance, connecting each of the conductors to the receptacle corresponding to the location on said panel element.

* * * * *